United States Patent [19]

Soma

[11] Patent Number: 4,785,752

[45] Date of Patent: Nov. 22, 1988

[54] MATERIAL FEEDER OF SEWING MACHINE

[75] Inventor: Yoshiro Soma, Kanagawa, Japan

[73] Assignee: Ikeda Bussan Co., Ltd., Ayase, Japan

[21] Appl. No.: 67,886

[22] Filed: Jun. 30, 1987

[30] Foreign Application Priority Data

Aug. 29, 1986 [JP] Japan ..... 61-132264[U]

[51] Int. Cl.[4] ..... D05B 47/04

[52] U.S. Cl. ..... 112/278; 112/80.73; 112/303; 200/61.18

[58] Field of Search ..... 112/278, 273, 272, 303, 112/80.73; 200/61.18

[56] References Cited

U.S. PATENT DOCUMENTS 3,906,876 9/1975 Fitton ..... 112/80.73
3,926,132 12/1975 Lear et al. ..... 112/80.73
3,994,245 11/1976 Smith ..... 112/278 X
4,408,554 10/1983 Takiguchi et al. ..... 112/278 X
4,590,879 5/1986 Matsubara et al. ..... 112/278
4,649,844 3/1987 Matsubara ..... 112/278 X
4,696,244 9/1987 Sampson et al. ..... 112/278 X

*Primary Examiner*—H. Hampton Hunter

*Attorney, Agent, or Firm*—Foley & Lardner, Schwartz, Jeffery, Schwaab, Mack, Blumenthal & Evans

[57] ABSTRACT

Herein disclosed is a material feeder of a sewing machine, which comprises a first mechanism which draws a predetermined length of a narrow and long material from a bobbin when actuated, and a second mechanism which actuates the first mechanism when the length of the material drawn from the bobbin is reduced to a predetermined degree.

12 Claims, 3 Drawing Sheets

MATERIAL FEEDER OF SEWING MACHINE

BACKGROUND OF THE INVENTION

1. Field of the Invention

The present invention relates in general to a sewing machine, and more particularly to a material feeder of the sewing machine, which feeds the sewing machine with a narrow and long material which is to be sewed.

2. Description of the Prior Art

In order to sew a narrow and long material with a sewing machine, there has been proposed a material feeder which comprises a rotatable bobbin on which the material is wound. Upon requirement of sewing, a leading end of the material is drawn from the bobbin and brought to a work portion of the sewing machine where a stitching needle and a material conveyor are positioned. During sewing operation, the material conveyor draws the material intermittently from the bobbin in response to the reciprocating movement of the needle. However, this intermittent material drawing by the conveyor causes application of considerable tension to the material due to an inevitable resistance of the bobbin against the drawing, viz., against the turning of itself. The tension tends to produce unsightly creases on the stitched material when the same is released from the sewing machine.

SUMMARY OF THE INVENTION

It is therefore an object of the present invention to provide an improved material feeder, for a sewing machine, which is free of the above-mentioned drawback.

According to the present invention, there is provided a material feeder from which a narrow and long material to be stitched is fed intermittently to the sewing machine without appliying a tension to the material.

According to the present invention, there is provided, in a sewing machine for sewing a narrow and long material which is drawn from a bottin, a material feeder which comprises first means for drawing a predetermined length of the material from the bobbin when actuated, and second means for actuating the first means when the length of the material drawn from the bobbin is reduced to a predetermined degree.

BRIEF DESCRIPTION OF THE DRAWINGS

Other objects and advantages of the present invention will be apparent from the following description when taken in conjunction with the accompanying drawings, in which.

DETAILED DESCRIPTION OF THE INVENTION

Figure 1:
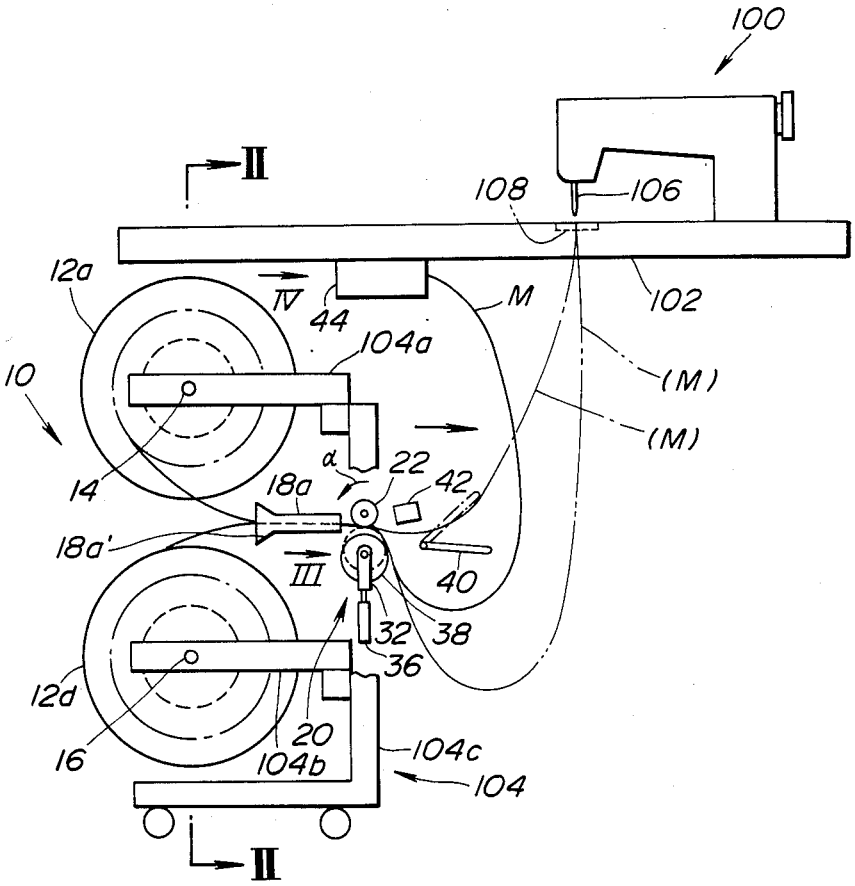
FIG. 1 is a schematic side view of a material feeder for a sewing machine, according to the present invention.

Referring to FIG. 1, there is shown a material feeder 10 of the present invention, which is incorporated with a known sewing machine 100. The sewing machine 100 illustrated is disposed on a table 102 mounted on a carrier 104 in which, as will be described hereinafter, the material feeder 10 is installed. Designated by numeral 106 is an eye-pointed needle of the sewing machine 100, which stitches a narrow and long material M which is drawn thereto from the material feeder 10. A known material conveyor 108 is arranged below the needle 106 to intermittently convey the material M forward during sewing operation of the sewing machine 100.

As is seen from FIG. 1, the carrier 104 is of a skeleton construction which comprises a pair of upper beams **104*a* and a pair of lower beams 104*b* which are supported horizontally by a rollaway frame 104*c***.

Figure 2:
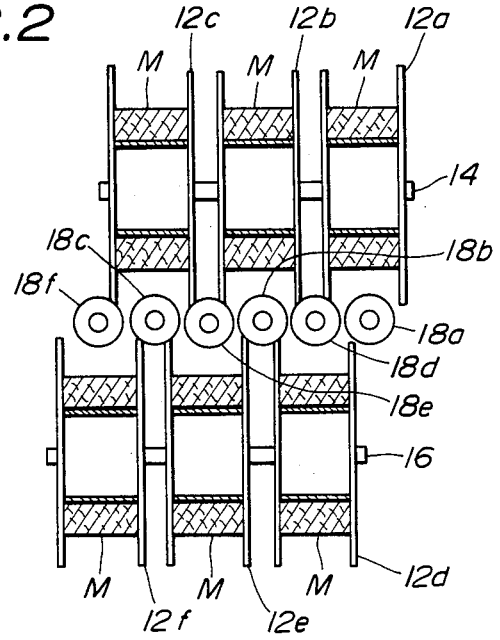
FIG. 2 is a sectional view taken along the line II—II of FIG. 1.

The material feeder 10 comprises a plurality of bobbins **12*a*, 12*b*, 12*c*, 12*d*, 12*e* and 12*f* (six in the disclosed embodiment) which are divided into two, viz., upper and lower groups each including the bobbins 12*a* to 12*c* or 12*d* to 12*f*, as is seen from FIG. 2. The bobbins 12*a* to 12*c* of the upper group are rotatably supported through an upper common shaft 14 by the upper beams 104*a*, while the bobbins 12*d* to 12*f* of the lower group are rotatably supported through a lower common shaft 16 by the lower beams 104*b*. Each bobbin has a narrow and long material M wound thereon, which material is to be stitched by the needle 106. As is best seen from FIG. 2, six guide pipes 18*a*, 18*d*, 18*b*, 18*e*, 18*c* and 18*f* are arranged abreast forward in the carrier 104*a* at the position between the upper and lower beams 104*a* and 104*b* but downstream of the bobbins 12*a* to 12*f* with respect to the flow of the narrow and long material M. Each guide pipe is located in the way of a material M drawn from the corresponding bobbin, as is understood from FIG. 2. Although not shown in the drawings, a suitable beam is arranged in the carrier 104 to support the guide pipes 18*a* to 18*f*. As is seen from FIG. 1, each guide pipe has a funnel-shaped opening 18*a'* for facilitating insertion of the material M thereinto. As will be described hereinafter, usually, all of the materials M are passed through the respective guide pipes 18*a* to 18*f* and upon sewing operation, one of them M is intermittently pulled toward the sewing machine 100** to be stitched.

Behind the guide pipes **18*a* to 18*f*, there is arranged a material drawing mechanism 20 which functions to intermittently draw selected one of the materials M from the corresponding bobbin in response to sewing operation of the sewing machine 100. The mechanism 20 comprises a roller bar 22 which is positioned behind the guide pipes 18*a* to 18*f* and extends along the row of the guide pipes, as is seen from FIG. 3. Preferably, the roller bar 22 has an elastomeric outer layer. As may be understood from FIG. 1, the roller bar 22 is rotatably supported by spaced parts of the vertically extending portion of the carrier 104. As is seen from FIG. 3, the roller bar 22 is driven in the direction of the arrow "$\alpha$" (see FIG. 1) by an electric motor 24 which is, in turn, controlled by a control unit 26 with a timer 28. As will be described hereinafter, due to the work of the timer 28, the rotation of the roller bar 22** is made periodically.

Figure 3:
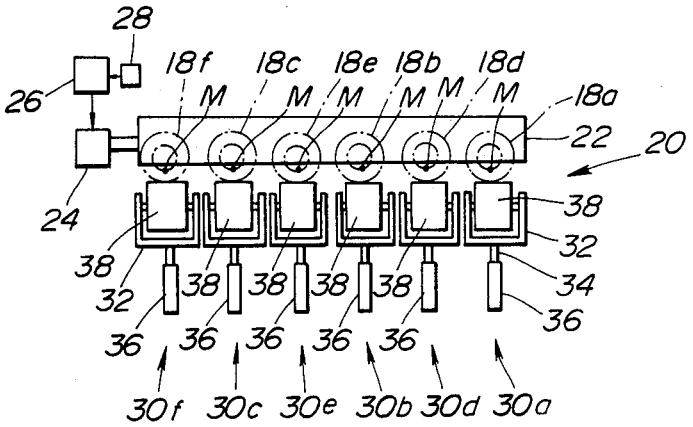
FIG. 3 is a view taken from the direction of the arrow III of FIG. 1.

As is seen from FIGS. 1 and 3, below the roller bar 22, there are arranged a plurality (six in the embodiment) of pressing followers **30*a*, 30*d*, 30*b*, 30*e*, 30*c* and 30*f*, each being capable of pressing the corresponding material M against the roller bar 22 when assuming a lifted position. For this, each pressing follower is located in the way of the corresponding material M, as is seen from FIG. 3, and comprises a holder 32 fixed to a piston rod 34 of an air cylinder 36, and a roller 38 rotatably connected to the holder 32**. Preferably, each roller 38 has an elastomeric outer layer. As may be understood from FIG. 1, the air cylinders 36 are fixed to the vertically extending portion of the carrier 104.

Referring back to FIG. 3, each pressing follower 30*a*, 30*d*, 30*b*, 30*e*, 30*c* or 30*f* can assume two positions, viz., a rest or down position wherein, as is shown in the drawing, the roller 38 is separated from the roller bar 22 and an upper or up position where the roller 38 is pressed against the roller bar 22. That is, as is seen from FIG. 1, upon application of compressed air to a cylinder 36, the corresponding piston rod 34 is lifted to move the corresponding roller 38 to the operative position illustrative by a broken line wherein the corresponding material M is compressed between the roller bar 22 and the roller 38. Thus, in this condition, rotation of the roller bar 22 in the direction of the arrow "α" forces the material M to move downstreamly, that is, toward the sewing machine 100.

At a downstream portion of the material drawing mechanism 20, there is pivotally arranged an antenna 40 which has a sufficient length to extend across the ways of the materials M which come from the material drawing mechanism 20. The antenna 40 is pivotal between the lower position illustrated by a solid line and an upper position illustrated by a broken line. Although not shown in the drawing, a suitable biasing means, such as spring or the like, is associated with the antenna 40 to bias the same downward, that is, toward the lower position, and suitable stoppers are arranged to suppress extreme movement of the antenna 40. A limit switch 42 connected to the control unit 26 for the motor 24 is located adjacent the antenna 40 to associate therewith. That is, when the antenna 40 assumes the upper position illustrated by the broken line, the switch 42 assumes its ON position and thus energizes the motor 24 for a given period of time.

Figure 4:
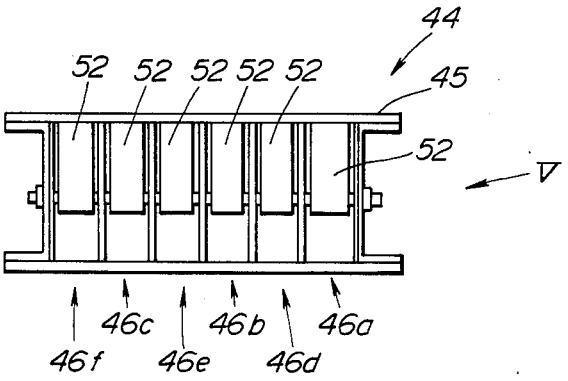
FIG. 4 is a view taken from the direction of the arrow IV of FIG. 1.
Figure 5A:
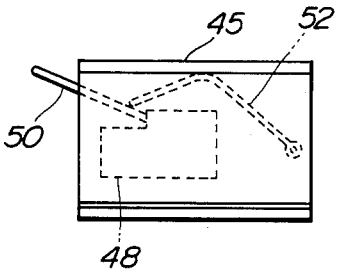
FIGS. 5A and 5B are views taken from the direction of the arrow V of FIG. 4, showing different conditions.
Figure 5B:
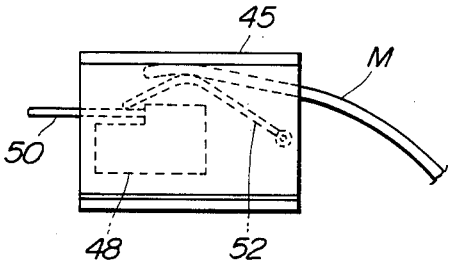

Beneath the table 102 of the sewing machine 100, there is mounted a holder 44 which functions to hold leading ends of the materials M when the latter are not subjected to sewing by the sewing machine 100. As is seen from FIG. 4, the holder 44 comprises a box, and six identical catch devices 46*a*, 46*d*, 46*b*, 46*e*, 46*c* and 46*f* which are arranged in the body, side by side. As is shown in FIG. 5A, each device comprises a switch 48 with an antenna 50, and a curved pivotal lever 52 the free end of which is in contact with the antenna 50 of the switch 48. Each switch is connected to an electromagnetic valve (not shown) by which air-feeding to the corresponding air cylinder 36 is controlled. The switch assumes its ON position when the antenna 50 is lifted as shown in FIG. 5A, and its OFF position when the antenna 50 is lowered as shown in FIG. 5B. The switch 48 is equipped with a suitable biasing means, such as a spring or the like, for biasing the antenna 50 toward the lifted, viz,. ON position of FIG. 5A. Thus, when the switches 48 are in their ON positions as shown in FIG. 5A, the corresponding electromagnetic valves open the air passages to the corresponding air cylinders 36 thereby lifting the corresponding pressing followers to their operative positions. When, as is seen from FIG. 5B, a leading end of the corresponding material M is pushed into the corresponding catch device and put between the lever 52 and the upper wall of the box 45 to be held, the antenna 50 is forced to pivot to the OFF position. That is, when the materials M are held by the holder 44, the pressing followers associated with these materials M assume their rest positions as shown in FIG. 3. However, when the materials M are pulled out from the holder 44, the associated pressing followers are lifted to the operative positions.

Prior to carrying out sewing of the material M with the sewing machine 100, the following preparations is made.

That is, the leading ends of the materials M are drawn from the bobbins and passed through the corresponding guide pipes 18*a* to 18*f*, a clearance between the roller bar 22 and the pressing followers and under the antenna 40 and brought upward to the folder 44 and thrusted into the corresponding catch devices 46*a*, 46*d*, 46*b*, 46*e*, 46*c* and 46*f* of the holder 44 to be held by the same. It is to be noted that upon completion of these steps, each material M is slackened to assume a dangled position as shown by a solid line in FIG. 1. Thus, in this condition, the switches in the holder 44 assume OFF positions as shown in FIG. 5B and thus the pressing followers 30*a* to 30*f* assume their inoperative positions as shown in FIG. 3. Furthermore, due to the slackened condition of the materials M, the switch 42 (see FIG. 1) assumes its OFF position and thus the motor 24 for the roller bar 22 is deenergized.

When, for carrying out sewing, one of the materials M is pulled out from the corresponding catch device of the holder 44, the switch of the corresponding catch device is turned to its ON position and thus, the corresponding pressing follower is lifted to its operative position. The leading end of the selected material M is then brought to the work position of the sewing machine 100 and held to the position by a known holder (not shown) of the sewing machine 100. In this condition, the material M takes such a position as illustrated by a dot-dot-dash line in FIG. 1, having no effect on the antenna. That is, the material M hangs loosely or dangles. Then, the sewing machine 100 is operated to allow the needle 106 to stitch the selected material M which is moved toward the work position due to the work of the material conveyor 108. Thus, during this sewing operation, the dangling portion of the material M is gradually raised and brought into contact with the antenna 40 and finally lifts the antenna 40 up to the upper position as illustrated by a dot-dash line in FIG. 1. With this, the switch 42 is turned ON thereby energizing the motor 24 for a given period of time and thus turning the roller bar 22 by given times. Thus, the material M is newly drawn from the material drawing mechanism 20 turning the corresponding bobbin, and the material M thus becomes to take the dangling position as illustrated by the dot-dot-dash line. Of course, this drawing speed is determined very higher than a speed at which the material M is pulled by the conveyor of the sewing machine. During the sewing operation, the above-mentioned motions are repeated. Thus, no tension is applied to the selected material M during the sewing operation, and thus the product, viz., the stitched material M is prevented from suffering the undesirable creases, unlike in case of the afore-mentioned conventional sewing machine.

When the selected material M is out, another material M is pulled out from the corresponding catch device of the holder 44 and brought to the work position of the sewing machine 100 for its sewing. During this sewing, the same operation as that mentioned hereinabove is carried out in the material feeder 10.

What is claimed is:

1. In a sewing machine for sewing a narrow and long material which is drawn from a bobbin, a material feeder which comprises:

first means for drawing a predetermined length of the material from said bobbin when actuated; and second means for actuating said first means when the length of the material drawn from the bobbin is reduced to a predetermined degree.

2. A material feeder as claimed in claim 1, in which said first means comprises:

a roller bar;

a pressing follower cable of pressing said material against the roller bar; and an electric drive unit for driving said roller bar to turn for a given period of time when energized.

3. A material feeder as claimed in claim 2, in which said second means comprises:

a pivotal antenna extending across the way of the material which is drawn from the second means; and a switch for energizing said electric drive unit when said antenna is pivoted to a given angular position.

4. A material feeder as claimed in claim 3, further comprising a holder for holding a leading end of said material when the material is not subjected to sewing.

5. A material feeder as claimed in claim 4, in which said holder comprises:

a holder proper which holds the leading end of the material; and a switch for causing the pressing follower to press the material against the roller bar when said leading end of the material is pulled out from the holder proper.

6. A material feeder as claimed in claim 2, in which said first means further comprises a guide pipe positioned upstream of the roller bar, through which the material from the bobbin is passed to smoothly guide the movement of thereof.

7. A material feeder as claimed in claim 2, in which said pressing follower comprises:

an air cylinder unit with a piston rod;

a holder fixed to the piston rod to move therewith; and a roller rotatably supported by the holder, said roller being pressed against the roller bar when the piston rod is projected from the cylinder unit.

8. A material feeder as claimed in claim 7, in which said roller has an outer cylindrical layer constructed of elastomeric material.

9. A material feeder as claimed in claim 2, in which said electric drive unit comprises:

an electric motor operatively connected to said roller bar; and a control unit with a timer, said control unit controlling said motor in a manner to energize the motor for a given period of time.

10. A material feeder as claimed in claim 3, in which said antenna is so arranged and positioned that when the material extending between the bobbin and the work position of the sewing machine is raised up to a predetermined level, the material is brought into contact with said antenna and finally lifts the same to said given angular position.

11. A material feeder as claimed in claim 10, in which said antenna is biased in a direction away from said given angular position.

12. A material feeder as claimed in claim 5, in which said holder proper comprises:

a box;

a curved lever housed in the box and pivotally connected at its one end to the box, said lever being biased in a direction to contact the curved portion of the lever with an inner wall of the box.

* * * * *